US008721113B2

(12) United States Patent
Lai et al.

(10) Patent No.: US 8,721,113 B2
(45) Date of Patent: May 13, 2014

(54) LAMP COVER AND LAMP STRUCTURE

(75) Inventors: Chun-Ming Lai, Yuanli Township, Miaoli County (TW); Shih-Chin Chou, Kaohsiung (TW); Chin-Kun Hsieh, Hsinchu (TW); Mei-Fen Lin, New Taipei (TW)

(73) Assignee: Lextar Electronics Corporation, Hsinchu (TW)

( * ) Notice: Subject to any disclaimer, the term of this patent is extended or adjusted under 35 U.S.C. 154(b) by 244 days.

(21) Appl. No.: 13/240,723

(22) Filed: Sep. 22, 2011

(65) Prior Publication Data

US 2012/0243216 A1 Sep. 27, 2012

(30) Foreign Application Priority Data

Mar. 22, 2011 (TW) ..... 100109770 A

(51) Int. Cl.

| | |
|---|---|
| ***F21V 21/00*** | (2006.01) |
| ***F21V 29/00*** | (2006.01) |
| ***F21V 5/04*** | (2006.01) |
| ***F21V 5/00*** | (2006.01) |

(52) U.S. Cl.

USPC ..... 362/217.02; 362/218; 362/217.12; 362/240; 362/249.02

(58) Field of Classification Search

USPC ..... 362/218, 217.12, 217.02, 249.02, 240

See application file for complete search history.

(56) References Cited

U.S. PATENT DOCUMENTS

| | | | | |
|---|---|---|---|---|
| 6,997,576 | B1 * | 2/2006 | Lodhie et al. | 362/240 |
| 7,476,004 | B2 * | 1/2009 | Chan | 362/240 |
| 7,938,562 | B2 * | 5/2011 | Ivey et al. | 362/276 |
| 7,976,185 | B2 * | 7/2011 | Uang et al. | 362/240 |

FOREIGN PATENT DOCUMENTS

CN 101603674 A 12/2009

OTHER PUBLICATIONS

English Abstract translation of CN101603674 (Published Dec. 16, 2009).

TW Office Action dated Apr. 18, 2013.

* cited by examiner

*Primary Examiner* — Stephen F Husar

*Assistant Examiner* — James Cranson, Jr.

(74) *Attorney, Agent, or Firm* — McClure, Qualey & Rodack, LLP

(57) ABSTRACT

A cover and a lamp structure. The cover whose curvature has a light incident surface and a light outgoing surface, and includes a plurality of 3D micro-structures disposed thereon and arranged in the form of an array. When a light is emitted into the light outgoing surface from the light incident surface, the light emitting angle of the light outgoing surface is increased through the refraction of the 3D micro-structures, so that the occurrence of mura or spots due to uneven distribution of the light is avoid.

19 Claims, 5 Drawing Sheets

| luminous efficiency | 90% |
|---|---|
| angle | 140° (Y-Z plane) 134° (X-Y plane) |

LAMP COVER AND LAMP STRUCTURE

This application claims the benefit of Taiwan application Serial No. 100109770, filed Mar. 22, 2011, the subject matter of which is incorporated herein by reference.

BACKGROUND OF THE INVENTION

1. Field of the Invention

The invention relates in general to a lamp structure, and more particularly to a lamp structure capable of increasing light emitting angle.

2. Description of the Related Art

In general, the LED light source, which provides illumination, can be used in various types of lamp structure such as the planar lamp device or the tubular lamp in majority. The planar lamp device has a light guide plate inside for refracting the light emitted by the LED light source disposed on the lateral side upwards so as to generate a planar light beam. The tubular lamp emits the light outwards through the light emitting surface of the LED light source directly. The shape of the cover of the tubular lamp is a curvature. However, due to the restrictions in the size and appearance of the cover, the design in the distance between light emitting surface of LEDs and the cover is poor and may cause visual problems or poor efficiency. If the distance is too short, hotspots may occur to the front side of the cover due to the concentration of the heat generated by the LEDs, and mura or spots may occur to the lateral sides of the cover due to an uneven distribution of luminance. Consequently, the uniformity and illumination range of the lamp are affected. On the other hand, if the distance is too large, the size and appearance of the lamp will be enlarged and the intensity of illumination will be insufficient. Consequently, more LEDs will be needed and the cost will be increased. Thus, the conventional lamp structure needs to be further improved no matter in terms of appearance or luminous uniformity.

SUMMARY OF THE INVENTION

The invention is directed to a cover and a lamp structure for increasing the light emitting angle and resolving the problems arising due to the concentration of the heat and an uneven distribution of luminance.

According to an aspect of the present invention, a lamp structure is provided. The lamp structure includes a tubular lamp casing, a light emitting diode (LED) array light source, two end caps and two couples of electrodes. The tubular lamp casing is formed by a cover and a substrate supporter. The cover is long-piece-shaped, and the long sides of the cover are fixed on the two sides of the substrate supporter to form a tubular structure. The cover whose curvature has a light incident surface and a light outgoing surface, and further includes a plurality of 3D micro-structures disposed thereon and arranged in the form of an array. The LED array light source is disposed in the tubular lamp casing for emitting a light. When the light is emitted into the light outgoing surface from the light incident surface, the light emitting angle of the light outgoing surface is increased through the refraction of the 3D micro-structures. Two end caps are disposed at the two ends of the tubular lamp casing. Two couples of electrodes are respectively disposed at the two ends of the tubular lamp casing and mounted on the two end caps for electrically connecting to the LED array light source.

According to an alternative aspect of the present invention, a cover is provided. The cover whose curvature has a light incident surface and a light outgoing surface, and further includes a plurality of 3D micro-structures disposed thereon and arranged in the form of an array. When a light is emitted into the light outgoing surface from the light incident surface, the light emitting angle of the light outgoing surface is increased through the refraction of the 3D micro-structures.

The above and other aspects of the invention will become better understood with regard to the following detailed description of the preferred but non-limiting embodiment(s). The following description is made with reference to the accompanying drawings.

DETAILED DESCRIPTION OF THE INVENTION

According to the lamp structure of the present embodiment of the invention, a plurality of 3D micro-structures are disposed on the cover for increasing the frequency of refraction and generating full reflection to avoid the light being directly emitted outwardly from the light emitting surface of light emitting diodes (LEDs) and avoid the occurrence of hotspots which indirectly affects luminance and results in multiple images or glare. Also, through the 3D micro-structures arranged in the form of an array, the light emitting angle of the light outgoing surface of the cover in the horizontal direction and the vertical direction is increased and the occurrence of mura or spots due to an uneven distribution of luminance of the cover is avoided.

Figure 1:
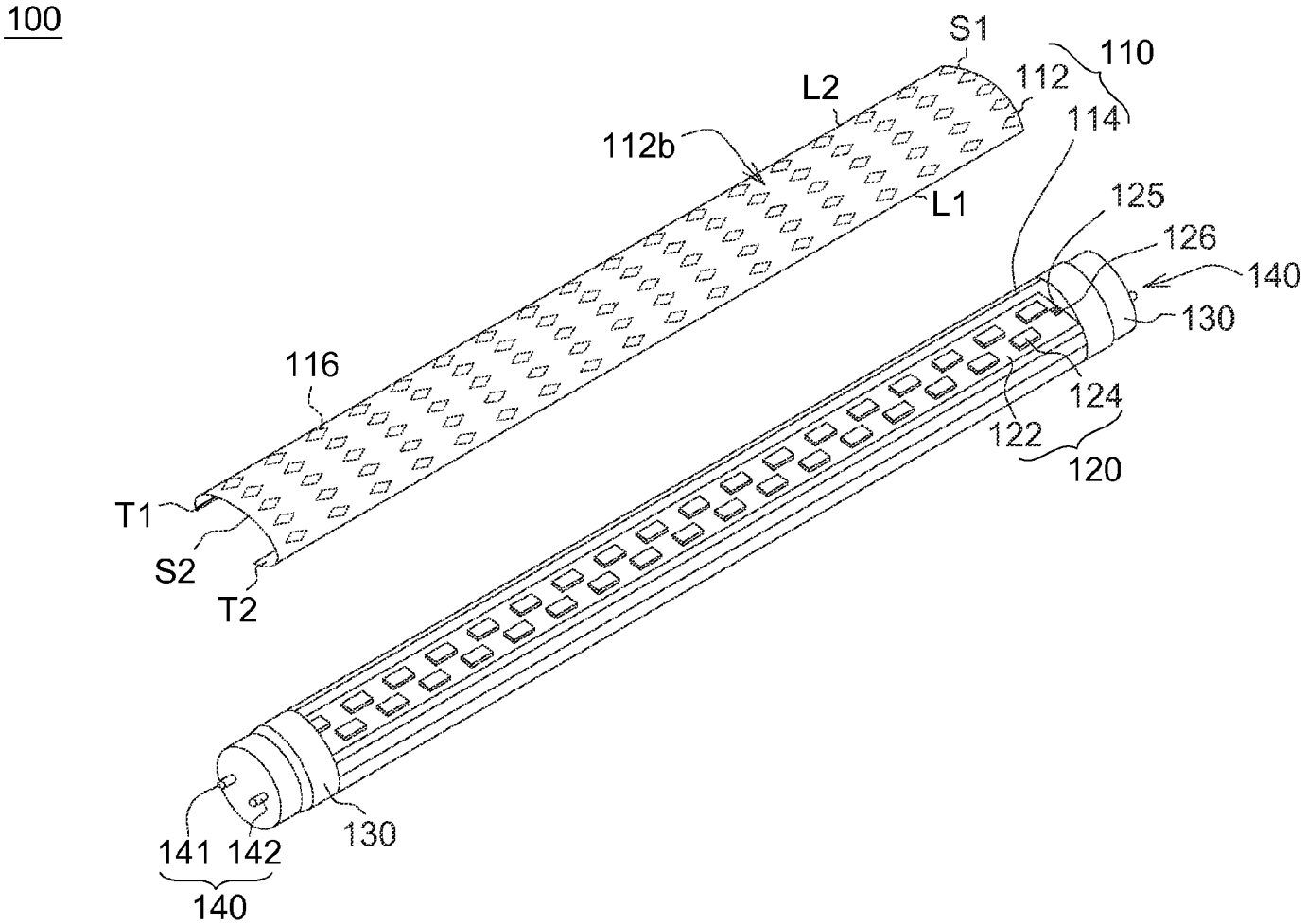
FIG. 1 shows a schematic diagram of a lamp structure according to an embodiment.
Figure 2:
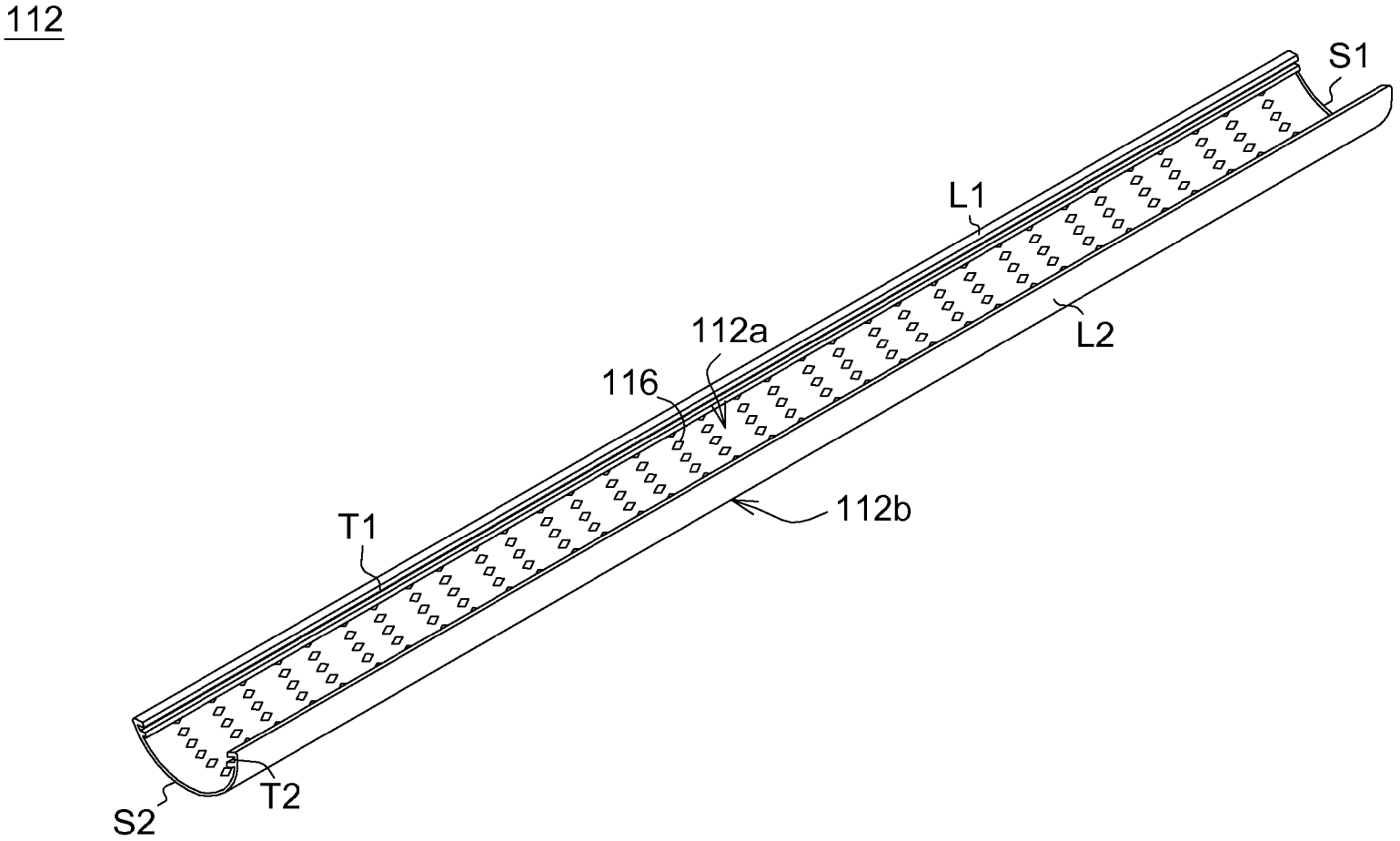
FIG. 2 shows an internal diagram of a cover according to an embodiment.

Referring to FIGS. 1 and 2. FIG. 1 shows a schematic diagram of a lamp structure according to an embodiment. FIG. 2 shows an internal diagram of a cover according to an embodiment. The lamp structure 100 includes a tubular lamp casing 110, an LED array light source 120, two end caps 130 and two couples of electrodes 140. The tubular lamp casing 110 is formed by a cover 112 and a substrate supporter 114. The cover 112 is long-piece-shaped, and the long sides L1 and L2 of the cover 112 are fixed on the two sides of the substrate supporter 114. The cover 112 whose curvature has a light incident surface 112*a* and a light outgoing surface 112*b*, and includes a plurality of 3D micro-structures 116 disposed thereon and arranged in the form of an array along the curvature of the cover 112. The LED array light source 120 is disposed in tubular lamp casing 110 for emitting a light, wherein when the light is emitted into the light outgoing surface 112*b* from the light incident surface 112*a*, the light emitting angle of the light outgoing surface 112*b* is increased through the refraction of the 3D micro-structures 116. Two end caps 130 are disposed at the two ends of the tubular lamp casing 110. Two electrodes 140 are disposed at the two ends of the tubular lamp casing 110 and mounted on the two end caps 130, and are electrically connected to the LED array light source 120.

In an embodiment, the LED array light source 120 includes a substrate 122 and a plurality of LEDs 124. The substrate 122 is for fixing the LEDs 124 on the substrate supporter 114. In practical application, the LEDs 124 can be attached on the substrate supporter 114 one by one, and the electrical connection between the LEDs 124 and the substrate 122 can be achieved by way of wiring or using flexible circuit board, so that the thermal resistance between the LEDs 124 and the substrate supporter 114 is reduced and heat dissipation is improved.

Referring to FIG. 2. In an embodiment, the cover 112 has two long sides L1 and L2 and two short sides S1 and S2. The cover 112 curls inwardly along the two long sides L1 and L2, such that the two short sides S1 and S2 of the cover 112 form a C-shaped curvature. The 3D micro-structures 116 are disposed on the light incident surface 112*a* (or the light outgoing surface 112*b*) of the cover 112, and are uniformly arranged in the form of an array along the long sides L1 and L2 and the short sides S1 and S2 of the cover 112, so that the 3D micro-structures 116 are located above the light emitting surface of each LED 124. The long sides L1 and L2 of the cover 112 are extended along the horizontal direction of the light incident surface 112*a*, and the short sides S1 and S2 of the cover 112 are extended along the tangent direction of the light incident surface 112*a*.

In an embodiment, the 3D micro-structures 116 have a plurality of refraction surfaces for increasing the frequency and angle of light refraction. Since the normal directions of the refraction surfaces are not in the same direction with the normal direction of the light incident surface 112*a*, the angle of the light refracted outwards from the refraction surface is different from the angle of the light refracted outwards from the light incident surface 112*a*, and the light emitting angles of the cover 112 in the horizontal direction (the long sides L1 and L2) and the vertical direction (the short sides S1 and S2) are increased. When the light of the LEDs 124 is emitted to the 3D micro-structures 116, the light is refracted by the refraction surface and diffused outwards in different directions instead of being concentrated right above the cover 112 to avoid the light being emitted from the light emitting surface of the LEDs 124 directly and generating hotspots.

The 3D micro-structures 116 can be a pyramid, a cone, a triangular pyramid, a fan-out cone, a semi-circular structure, a dripping shape structure or a deformation thereof, and no specific restriction is applied in the invention. The 3D micro-structures 116 can be integrally formed on the light incident surface 112*a* (or the light outgoing surface 112*b*) of the cover 112 in one piece by way of mold extrusion process or tool-cutting or rolling process. In an embodiment, during the extrusion process of the cover 112, the patterns of the 3D micro-structures 116 are formed on the light incident surface 112*a* (or the light outgoing surface 112*b*) by pressing a conic or arc tool on the cover 112. In an alternative embodiment, the 3D micro-structures 116 can also be formed on the light incident surface 112*a* (or the light outgoing surface 112*b*) of the cover 112 by way of patterned printing.

Figure 3A:
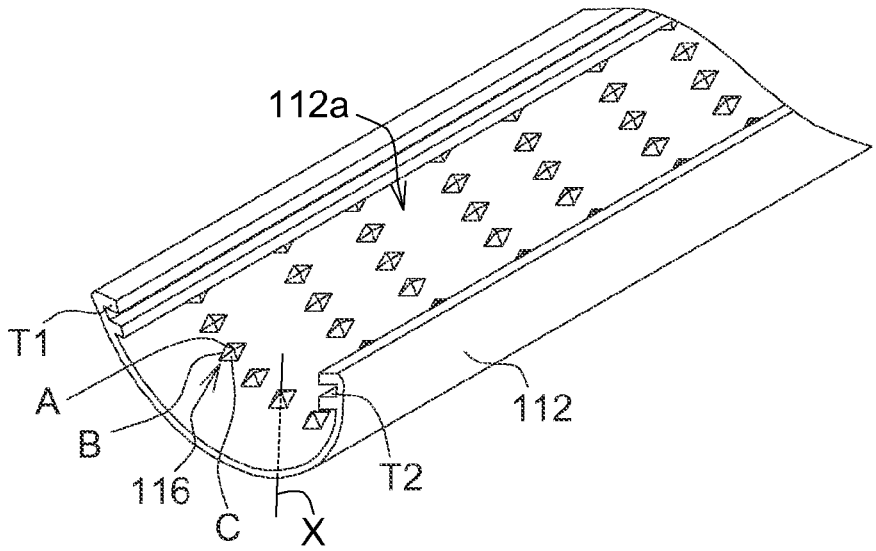
FIG. 3A shows a schematic diagram of 3D micro-structures according to an embodiment.
Figure 3B:
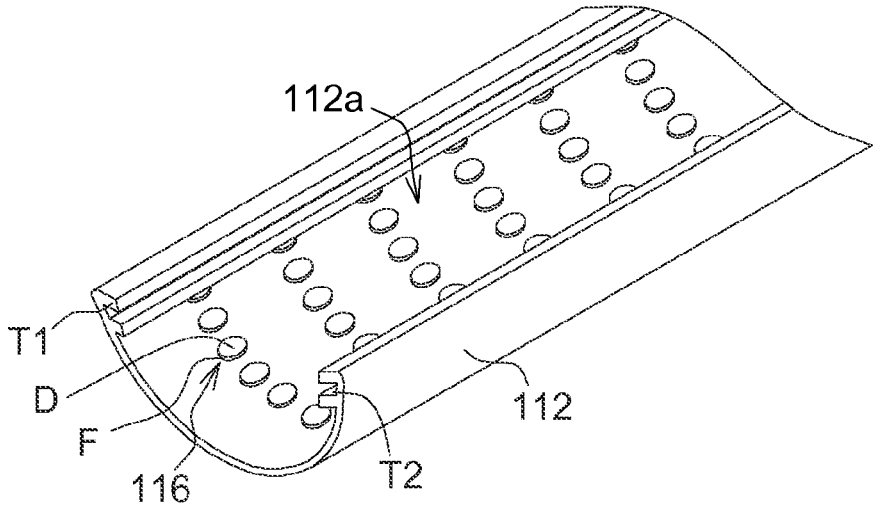
FIG. 3B shows another schematic diagram of 3D micro-structures according to an embodiment.

Referring to FIG. 3A, a schematic diagram of 3D micro-structures 116 according to an embodiment is shown. Each 3D micro-structure 116, such as a pyramid, has an apex A, a tetragonal base B and four triangular surfaces C. Each triangular surface C is a refraction surface whose normal direction is not in the same direction with the normal direction X of the light incident surface 112*a* passing through the apex A. The 3D micro-structure can also be realized by any structure other than a pyramid, and no specific restriction is applied here. Referring to FIG. 3B, another schematic diagram of 3D micro-structures according to an embodiment is shown. Each 3D micro-structure 116, such as a flat-topped cone, has a top surface D and a conical surface F. During the manufacturing of the cover 112, two strip-shaped grooves T1 and T2 are formed on two opposite sides of the cover 112 along the long sides L1 and L2 and face toward the light incident surface 112*a* for fixing the cover 112 on the substrate supporter 114 to form a tubular lamp casing 110.

Referring to FIG. 1. In an alternative embodiment, the substrate supporter 114, formed by a heat-dissipating metal such as copper or aluminum, has sufficient strength and thickness. The substrate supporter 114 is strip-shaped and used for fixing the LED array light source 120 along the horizontal direction (the long sides L1 and L2) in tubular lamp casing 110 and absorbing the heat generated by the LEDs 124 to avoid the heat being concentrated inside the LED 124 and affecting the luminous efficiency.

The substrate 122, realized by such as an aluminum substrate, can be formed by several substrates connected in a longitudinal direction. The short lateral sides of the substrate 122 have an anode wiring terminal 125 and a cathode wiring terminal 126 respectively for connecting the two electrodes 140 located on the same side. In an alternative embodiment, the substrate 122 of the LED array light source 120 can be adhered on the substrate supporter 114 by a thermal conductive glue. The LEDs 124 are arranged on the substrate 122 in the form of an array to form an array of light source. Moreover, tubular lamp casing 110 can further have a light equalizer or diffuser disposed inside for diffusing the emitting light of the LED array light source 120 uniformly.

Furthermore, the end caps 130 are disposed at the two ends of the tubular structure 108, such that the two ends of the tubular structure 108 are closed. In an alternative embodiment, the end caps 130 can have a starter disposed inside for providing a DC current and enabling the LED 124 of the tubular lamp casing 110 to generate electroluminescence. In an alternative embodiment, the starter can also be disposed under the substrate supporter 114.

Besides, each couple of electrodes 140 includes a positive electrode 141 and a negative electrode 142. Each couple of electrodes 140 is disposed at one end of the tubular lamp casing 110 and mounted on the end cap 130 and is connected to an external power for electrically connecting to the substrate 122 of the LED array light source 120 to provide the necessary power. One end of each couple of electrodes 140 is protruded from the end cap 130 along a horizontal direction (the two long sides L1 and L2) and can be inserted into the socket of the fluorescent tube in the prior art. Thus, the lamp structure 100 of the present embodiment can replace the conventional fluorescent tube. Furthermore, compared with the conventional fluorescent tube, the LEDs 124 of the lamp structure 100 has longer lifespan, lower replacement frequency, and higher luminous efficiency, hence saving more power consumption.

Figure 4A:
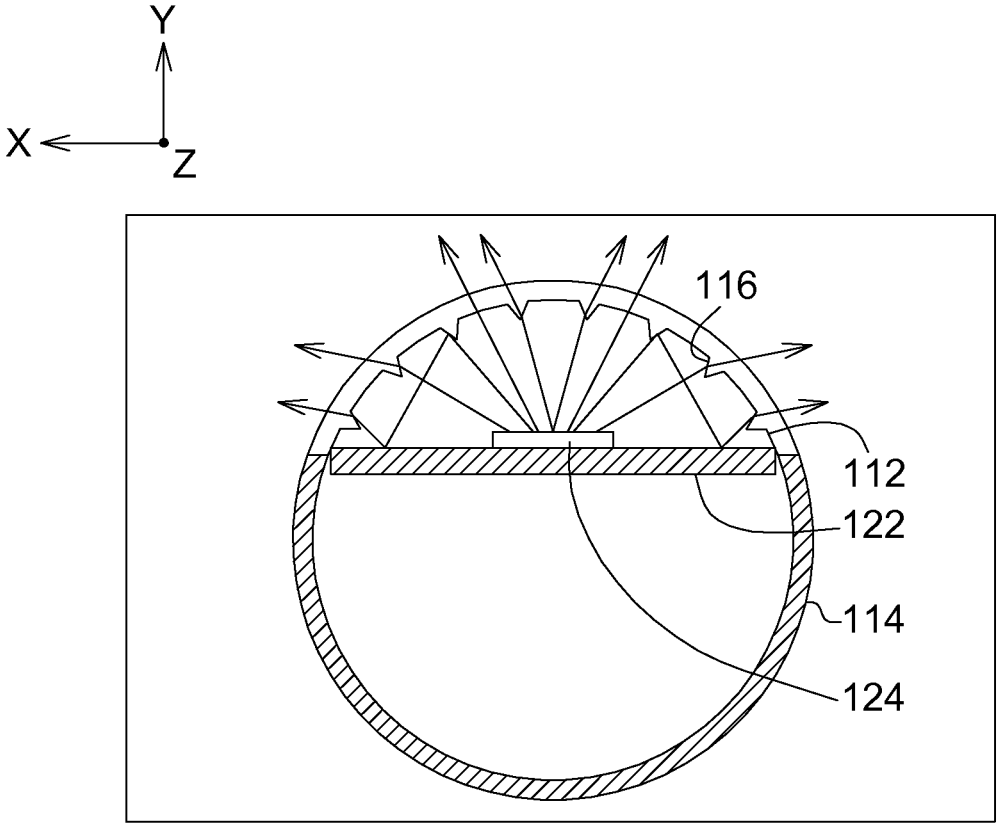
FIG. 4A shows a diagram of the radiation fields of a lamp structure with 3D micro-structures according to an embodiment.
Figure 4B:
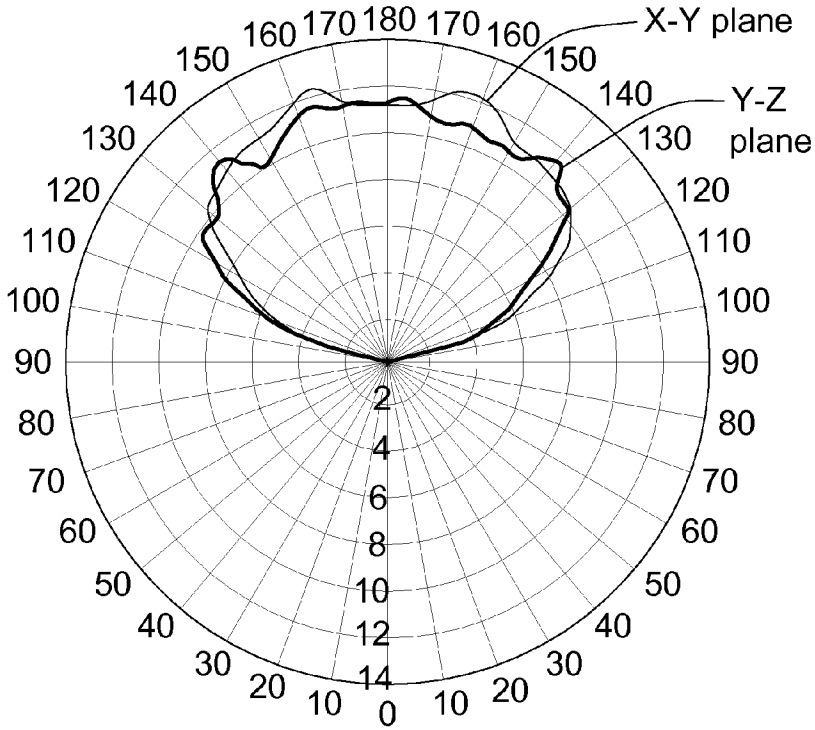
FIG. 4B shows a distribution diagram of the light fields measured on the X-Y plane and the Y-Z plane the according to the lamp structure of FIG. 4A.

Referring to FIGS. 1 and 4A-4B. FIG. 4A shows a diagram of the radiation fields of a lamp structure with 3D micro-structures according to an embodiment. FIG. 4B shows a distribution diagram of the light fields measured on the X-Y plane and the Y-Z plane the according to the lamp structure of FIG. 4A. As indicated in the results of measurement, in comparison to the conventional cover with a smooth surface on which the 3D micro-structures 116 are not disposed, the light emitting angle on the light outgoing surface of the lamp structure 100 of the present embodiment is increased from 120 degrees to at least 140 degrees in the horizontal direction (along the long sides L1 and L2), and is increased from 130 degrees to at least 134 degrees in the vertical direction (along the short sides S1 and S2). Thus, the light emitting angles of the lamp structure 100 of the present embodiment in the horizontal direction and the vertical direction are increased without changing the number and disposition of the LEDs 124 or the current restrictions in the size and appearance of the cover. For example, the 3D micro-structures 116 are disposed on the lateral sides of the cover 112 for refracting the light to the two sides instead of concentrating right above the cover 112. In addition, the 3D micro-structures 116 are disposed right above the cover 112 for fully reflecting a part of the light onto the substrate 122. Then, the portion of the light, having been reflected in the tubular lamp casing 110 for one or several times, is emitted to the 3D micro-structures 116 disposed on the lateral sides or terminal portion of the cover 112 and then refracted to the two sides instead of concentrating right above the cover 112. Since the light emitting angle of the light incident surface 112*a* is increased in the vertical direction, mura or spots arising from an uneven distribution of luminance are not seen on the lateral sides of the cover 112 when the cover 112 is examined from a lateral side towards the interior. Since the light emitting angle of the light incident surface 112*a* is also increased in the horizontal direction, mura or spots arising from an uneven distribution of luminance are not seen on the terminal portion of the cover 112 when the cover 112 is examined from the front side towards the two end caps 130 near the terminal portions.

The lamp structure disclosed in the above embodiments has many features exemplified below:

(1) The cover can be semi-transparent, milky white or other color, and the light incident surface of the cover has 3D micro-structures disposed thereon and arranged in the form of an array to avoid the light being directly emitted outwardly from the light emitting surface of LEDs and generating hotspots which indirectly affect luminance and result in multiple images or glare.

(2) The 3D micro-structures has a plurality of beveled or arced refraction surfaces for increasing the frequency and angle of light refraction so that the light is not concentrated right above the cover and the light emitting angle of the light emitting surface is increased.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A lamp structure, comprising:

a tubular lamp casing formed by a cover and a substrate supporter, wherein the cover is long-piece-shaped and long sides of the cover are fixed on two sides of the substrate supporter to form a tubular structure, the cover whose curvature has a light incident surface and a light outgoing surface and comprises a plurality of 3D micro-structures disposed thereon and arranged in the form of a matrix array;

a light emitting diode (LED) array light source disposed in the tubular lamp casing for emitting a light, wherein when the light is emitted into the light outgoing surface from the light incident surface, the light emitting angle of the light outgoing surface is increased through the refraction of the 3D micro-structures;

two end caps disposed at the two ends of the tubular lamp casing; and two couples of electrodes respectively disposed at two ends of the tubular lamp casing and mounted on the two end caps and electrically connected to the LED array light source.

2. The lamp structure according to claim 1, wherein the cover has two long sides and two short sides, and the two short sides form a C-shaped curvature along arc of the end caps.

3. The lamp structure according to claim 1, wherein the LED array light source comprises a plurality of LEDs disposed on the substrate supporter.

4. The lamp structure according to claim 1, wherein the LED array light source further comprises a substrate and a plurality of LEDs, and the substrate is used for fixing the LEDs on the substrate supporter.

5. The lamp structure according to claim 1, wherein each of the 3D micro-structures has a plurality of refraction surfaces, and the normal directions of the refraction surfaces are not in the same direction with the normal direction of the light incident surface.

6. The lamp structure according to claim 1, wherein the 3D micro-structures are integrally formed on the cover in one piece by way of extruding or rolling process.

7. The lamp structure according to claim 1, wherein the 3D micro-structures are formed on the cover by way of printing.

8. The lamp structure according to claim 1, wherein two strip-shaped grooves are formed on two opposite sides of the cover along the long sides and face toward the light incident surface for fixing the cover on the substrate supporter.

9. The lamp structure according to claim 1, wherein the substrate supporter is a heat-dissipating metal.

10. The lamp structure according to claim 1, wherein the cover is semi-transparent.

11. The lamp structure according to claim 1, wherein the 3D micro-structures are disposed on the light incident surface or the light outgoing surface.

12. A cover whose curvature has a light incident surface and a light outgoing surface and comprises a plurality of 3D micro-structures disposed thereon and arranged in the form of a matrix array, wherein when a light is emitted into the light outgoing surface from the light incident surface, light emitting angle of the light outgoing surface is increased through the refraction of the 3D micro-structures.

13. The cover according to claim 12, wherein the cover has two long sides and two short sides, and the two short sides form a C-shaped curvature.

14. The cover according to claim 12, wherein each of the 3D micro-structures has a plurality of refraction surfaces, and normal directions of the refraction surfaces are not in the same direction with a normal direction of the light incident surface.

15. The cover according to claim 12, wherein the 3D micro-structures are integrally formed on the cover in one piece by way of extruding or rolling process.

16. The cover according to claim 12, wherein the 3D micro-structures are formed on the cover by way of printing.

17. The cover according to claim 12, wherein the 3D micro-structures are disposed on the light incident surface or the light outgoing surface.

18. The lamp structure according to claim 1, wherein each of the 3D micro-structures is a square based pyramid, a triangular pyramid, a fan-out cone, a semi-circular structure, or a dripping shape structure.

19. The cover according to claim 12, wherein each of the 3D micro-structures is a square based pyramid, a triangular pyramid, a fan-out cone, a semi-circular structure, or a dripping shape structure.

* * * * *